US007699722B1

(12) United States Patent
Neu et al.

(10) Patent No.: US 7,699,722 B1
(45) Date of Patent: Apr. 20, 2010

(54) ADJUSTABLE HEIGHT GOLF TEE

(75) Inventors: Kenneth Neu, Fort Myers, FL (US); Robert C Irion, Fort Myers, FL (US)

(73) Assignee: Kenneth Neu LLC, Fort Myers, FL (US)

( * ) Notice: Subject to any disclaimer, the term of this patent is extended or adjusted under 35 U.S.C. 154(b) by 0 days.

(21) Appl. No.: 12/315,919

(22) Filed: Dec. 8, 2008

(51) Int. Cl.
*A63B 57/00* (2006.01)

(52) U.S. Cl. ..... 473/400; 473/398

(58) Field of Classification Search ..... 473/387–403; D21/717, 718
See application file for complete search history.

(56) References Cited

U.S. PATENT DOCUMENTS

| | | | | | |
|---|---|---|---|---|---|
| 1,616,059 | A * | 2/1927 | Mulvehill | 473/398 |
| 1,625,911 | A * | 4/1927 | Richards | 473/398 |
| 3,114,557 | A * | 12/1963 | Cabot | 473/398 |
| 3,203,700 | A * | 8/1965 | Antonious | 473/398 |
| 3,408,079 | A * | 10/1968 | Kirikos | 473/398 |
| D370,041 | S * | 5/1996 | Thomas | D21/718 |
| 5,672,122 | A * | 9/1997 | Strong | 473/398 |
| 6,729,977 | B1 * | 5/2004 | Young et al. | 473/398 |
| 7,488,263 | B2 * | 2/2009 | Lee | 473/394 |
| 2005/0026726 | A1 * | 2/2005 | Barouh | 473/398 |
| 2006/0166765 | A1 * | 7/2006 | Holtzman | 473/387 |
| 2006/0199669 | A1 * | 9/2006 | Barouh | 473/398 |
| 2008/0039238 | A1 * | 2/2008 | Lee | 473/400 |
| 2009/0088274 | A1 * | 4/2009 | Blais | 473/398 |
| 2009/0253536 | A1 * | 10/2009 | Funke | 473/398 |

* cited by examiner

*Primary Examiner*—Steven Wong

(57) ABSTRACT

A tee portion and a height regulating portion cooperate to form a height adjustable golf tee where the user may readily and easily adjust placement of the height regulating portion relative to a placement zone along the tee portion and lock the height regulating portion at a desired location defined by the user. The height regulating portion is locked onto the tee portion during assembly where it may not inadvertently become separated during use, transport or storage. The height regulating portion is easily transferred between an adjustment position and a locking position utilizing a simple toggle like action. The height adjustable golf tee provides for a golf ball to be retained consistently at a user defined elevation above the ground during play of the game of golf.

19 Claims, 5 Drawing Sheets

FIG. 2a
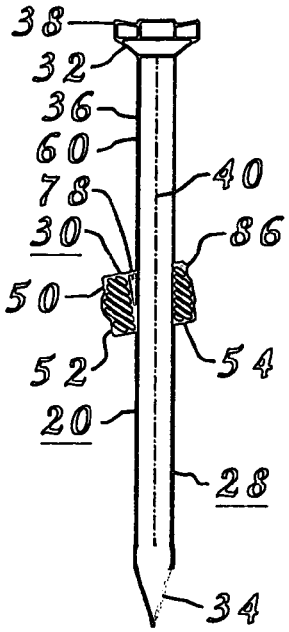
FIG. 2b
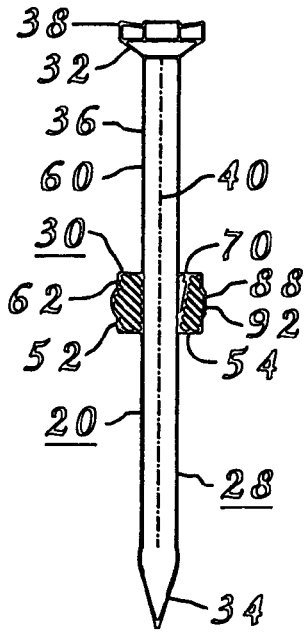
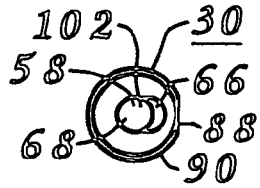
FIG. 4a
FIG. 3a
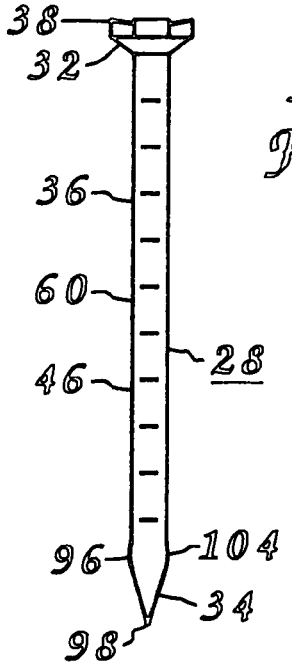
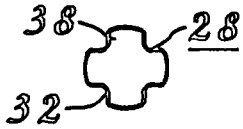
FIG. 3b
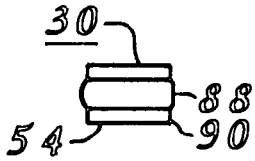
FIG. 4b
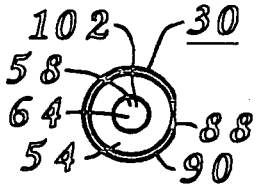
FIG. 4c

ADJUSTABLE HEIGHT GOLF TEE

BACKGROUND

1. Field of the Invention

Generally, the invention relates to golf tees to support a golf ball above the ground during lay of the game of golf. More specifically, the invention relates to height adjustable golf tees which have a portion which may be manipulated by the user to provide for a user selectable height of a golf ball positioned on the height adjustable golf tee relative to the ground.

2. Description of the Prior Art

The game of golf is enjoyed by many persons. Such players range from beginner players to occasional recreational players to serious recreational players to serious amateur players to professional players. Many regular non-professional players, including retired or semi-retired persons, routinely enjoy the game of golf on a very regular basis. It is common to have players of golf living in communities which have at least one golf course owned and operated by the community. Such players often enjoy a round of golf on a very regular schedule, including daily.

Tees are devices which typically penetrate the ground and have a golf ball contact structure positioned thereon where a golf ball is retained in an elevated position above the ground for ready striking by the player utilizing a golf club. Typically golf tees are utilized to elevate the golf ball above the ground during the initial stroke during each hole of play. Each player will have a personal preference for elevational height of the golf ball depending upon which club is utilized. Some players prefer the golf ball to be positioned fairly close to the ground. Some players prefer the golf ball to be retained at a higher elevation from the ground. Head size for a respective club will often influence the players desired placement of the golf ball relative to the ground. The condition of the grass may also factor into a specific players selection of elevation of their golf ball.

Each player may have their own unique method of placing their tee where their golf ball is retained at a desired elevation above the ground. This typically involves manually manipulating their tee during insertion in the ground, stepping back to observe the tee often with a golf ball resting thereon, then readjusting if judged to be too high or too low relative to the ground. This arrangement provides for a very imprecise placement which, due to the inconsistency of placement, tends to adversely effect overall performance of the player during play of the game of golf.

A wide variety of golf tees having insertion limits have been proposed including versions having user selectable adjustment of the insertion limiting structure along the tee portion where the user may select an elevational position of a golf ball positioned on the tee. Typically these adjustable structures are formed of two (2) parts which may easily be separated by the user. Additionally, these adjustable structures typically have a limited number of placement locations of the insertion limiting structure relative to the tee portion. Some elevational placement tees merely have a single insertion limiting structure fixedly positioned on the tee to prevent over insertion into the ground where the golf ball is retained at a predefined elevation when the tee is completely inserted to the insertion limiting structure.

Various deficiencies exist with each of the known methods of providing for placement of a golf ball at a desired elevation above the ground during play of the game of golf. As can be seen various attempts have been made to provide for a golf tee having structures to provide for the user to establish an elevational height relative to the ground. These attempts have been less efficient than desired. As such, it may be appreciated that there continues to be a need for a simple, sturdy, dependable, accurate, adjustable height golf tee where the user may quickly and easily establish a height setting on the golf tee and where that established height setting remains undisturbed during storage and transport of the adjustable height golf tee. The present invention substantially fulfills these needs.

SUMMARY

In view of the foregoing disadvantages inherent in the known methods of regulating elevational placement of golf balls above the ground during play of the game of golf, your applicants have devised a height adjustable golf tee to support a golf ball above the ground at a user selectable elevation during play of the game of golf. The height adjustable golf tee has a tee portion and a height regulating portion. The tee portion has a golf ball placement end, a spike end and a placement zone. The golf ball placement end has a golf ball support area to contact the golf ball to retain the golf ball relative to the tee portion where the golf ball is retained at a desired elevational position above the ground during the play of the game of golf. The spike end penetrates the ground while the height adjustable golf tee is supporting the golf ball above the ground during play of the game of golf. The placement zone is positioned between the spike end and the golf ball placement end. The height regulating portion slidably engaging the tee portion along the placement zone. The height regulating portion has a ground contact side for placement relative to the ground during an insertion of the height adjustable golf tee into the ground during play of the game of golf. The height regulating portion has an adjustable position relative to the placement zone portion of the tee portion and a locking position relative to the placement zone portion of the tee portion. The adjustable position provides for the user to selectably move the height regulating portion along the placement zone to vary a spacing of the ground contact side of the height regulating portion relative to the golf ball support area of the tee portion and position the height regulating portion at any desired placement position along the placement zone of the tee portion. The locking position provides for the user to lock the ground contact side of the height regulating portion at a user selected placement position selected from any desired position along the placement zone of the tee portion.

Our invention resides not in any one of these features per se, but rather in the particular combinations of them herein disclosed and it is distinguished from the prior art in these particular combinations of these structures for the useful functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a height adjustable golf tee where the user may adjust the height adjustable golf tee to select a height at which a golf ball positioned on the height adjustable golf tee will be retained above the ground during use.

Other objects include;

a) to provide for the height adjustable golf tee for be formed of just two (2) parts, a tee portion and an height regulating portion.

b) to provide for the two (2) parts of the height adjustable golf tee to be locked together where incidental disconnect may not readily occur.

c) to provide for the height adjustable golf tee to have an infinite range of adjustment along a placement zone where any desired elevational spacing, within an acceptable range for the height adjustable golf tee, may be selected by the user.

d) to provide for the height adjustable golf tee to have markings on the tee portion indicative of the elevation of a golf ball retained on the height adjustable golf tee from the ground.

e) to provide for the height regulating portion of the height adjustable golf tee to readily and easily be moved by the user along the tee portion while in an adjustable position relative to the tee portion.

f) to provide for the height regulating portion of the height adjustable golf tee to be securely retained on the tee portion while in a locking position relative to the tee portion.

g) to provide for the height regulating portion to be angularly offset relative to the tee portion while in the adjustable position relative to the tee portion where the user can easily and simply recognize that the height adjustable golf tee is in an adjustment orientation.

h) to provide for the height regulating portion to be generally perpendicular relative to an axis of the tee portion while in the locking position relative to the tee portion where the user can easily and simply recognize that the height adjustable golf tee is in a locked and set orientation.

i) to provide for the height adjustable golf tee to have a simple and easy toggle like transfer of the height regulating portion relative to the tee portion between the locking position and the adjustment position.

j) to provide for the height regulating portion to have a dual position passageway therethrough with a common exit opening on one side of height regulating portion and opposing identifiable openings on the opposing side of height regulating portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 2*a* and FIG. 2*b* are elevational views of the adjustable height golf tee shown in FIG. 1*b* and FIG. 1*c* respectively with the facing half of the height regulating portion removed.

FIG. 3*a* is an elevational view of a tee portion of the adjustable height golf tee.

FIG. 3*b* is a top plan view of the tee portion shown in FIG. 3*a*.

FIG. 4*a* is a top plan view of the height regulating portion of the adjustable height golf tee.

FIG. 4*b* is an elevational view of the height regulating portion shown in FIG. 4*a*.

FIG. 4*c* is a bottom plan view of the height regulating portion shown in FIG. 4*a* and FIG. 4*b*.

DESCRIPTION

Figure 1A:
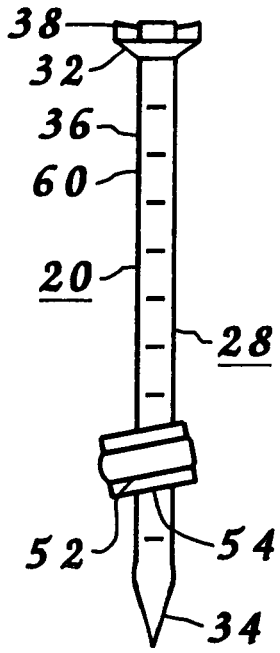
FIG. 1*a* through FIG. 1*c* are elevational views of an adjustable height golf tee in various functional orientations.

Many different height adjustable golf tees having features of the present invention are possible. The following description describes the preferred embodiment of select features of those height adjustable golf tees and various combinations thereof. These features may be deployed in various combinations to arrive at various desired working configurations of height adjustable golf tees.

Reference is hereafter made to the drawings where like reference numerals refer to like parts throughout the various views.

Overview

A height adjustable golf tee 20, or portions thereof, are depicted in the various views. Height adjustable golf tee 20 supports a golf ball 22 above ground 24 at a user, not shown in any of the various views, selectable elevational position, see 26 as example, during play of the game of golf. Height adjustable golf tee 20 has a tee portion 28 and a height regulating portion 30.

Tee Portion

Tee portion 28 has a golf ball placement end 32, a spike end 34 and a placement zone 36 situated between golf ball placement end 32 and spike end 34. Golf ball placement end 32 has a golf ball support area 38 which contacts golf ball 22 to retain golf ball 22 relative to tee portion 28 where golf ball 22 is retained at a desired elevational position 26 above ground 24 during the play of the game of golf. Spike end 34 penetrates ground 24 while height adjustable golf tee 20 is supporting golf ball 22 above ground 24 during play of the game of golf. Placement zone 36 is positioned between spike end 34 and golf ball placement end 32. In the preferred embodiment depicted placement zone 36 has an axis 40 and a generally uniform shape 42 and dimensional sizing 44 along an entire length 46 of placement zone 36. Placement zone 36 may have any desired cross section configuration desired.

If desired tee portion 28 may have markings 48 thereon to indicate to the user a spacing from ground 24 which golf ball 22 will be positioned for at least select adjustment positions of height regulating portion 30 along placement zone 36 of tee portion 28. These marking may be mere marks or may include actual measurements or may include notations indicative of a certain golf club type. FIG. 3*a* depict a series of markings 48 along placement zone 36 of tee portion 28 indicative of a measurement spacing of golf ball support area 38 of tee portion 28 relative to ground 24 when spike end 34 of tee portion 28 of height adjustable golf tee 20 is inserted in ground 24 during the play of the game of golf. The measurement spacing of golf ball support area 38 relative to ground 24 regulated by placement of height regulating portion 30 at a placement position 50 of height regulating portion 30 relative to placement zone 36 of tee portion 28 selected by the user.

Many configurations are known in the art for the actual golf ball contact surface(s) of tees and any of these may be utilized with the present invention. Examples include those conventional radially contacting dimpled configurations, those having spaced contacting surfaces in general radial orientations, those having flexible member(s) extending upward, such as brush tees, and those having hinged portions where the ball contacting portion pivots during usage.

Preferably tee portion 28 will be formed by an injection molding process from a plastic material. Conventional plastic tees are routinely molded utilizing deep cavity molds where the shaft of the tee has a slight taper therealong to permit release from the mold during manufacture. Tee portion 28 is ideally molded utilizing opposing molds having symmetrically configured cavities. This arrangement permits a uniform dimensional sizing of at least placement zone 36 of tee portion 28.

Height Regulating Portion

Figure 1B:
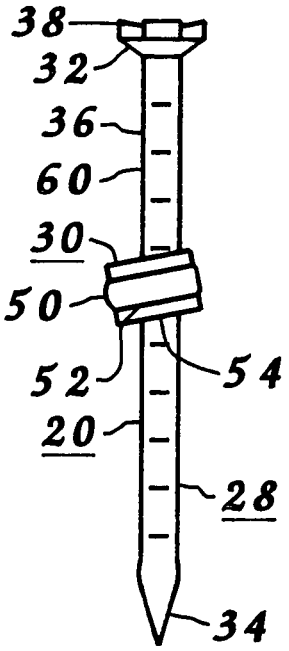
Figure 1C:
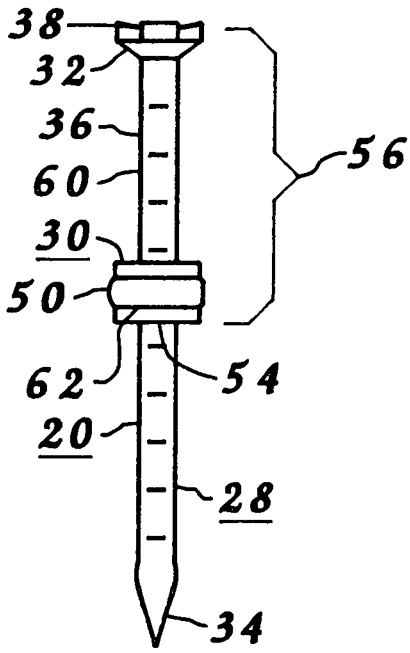

Height regulating portion 30 slidably engages tee portion 28 along placement zone 36. Height regulating portion 30 has a ground contact side 54 for placement relative to ground 24 during an insertion of height adjustable golf tee 20 into ground 24 during play of the game of golf. Height regulating portion 30 slidably engages tee portion 28 along placement zone 36 for user selectable placement in any desired position within an infinite number of adjustment locations limited only by precision of measurement restrictions. Height regulating portion 30 has an adjustable position 52 relative to placement zone 36 of tee portion 28, see FIG. 1*b*. Adjustable position 52 provides for the user to be able to selectably move height regulating portion 30 along placement zone 36 to vary a placement position, see example 50 in FIG. 1*b* and FIG. 1*c*, of ground contact side 54 of height regulating portion 30 relative to golf ball support area 38 of tee portion 28 and position height regulating portion 30 at any desired placement position along placement zone 36 of tee portion 28.

Height regulating portion 30 has a dual position passageway 58 therethrough to receive a portion 60 of tee portion 28 corresponding to placement zone 36. Dual position passageway 58 provides for user selective transfer of height regulating portion 30 relative to placement zone 36 of tee portion 28 between the opposing positions, adjustable position 52 and a locking position 62. The respective placement position selected and utilized of height regulating portion 30 along placement zone 36 of tee portion 28 may be selected at any position along placement zone 36 by the user from an infinite number of adjustment locations limited only by precision of measurement restrictions.

Figure 8A:
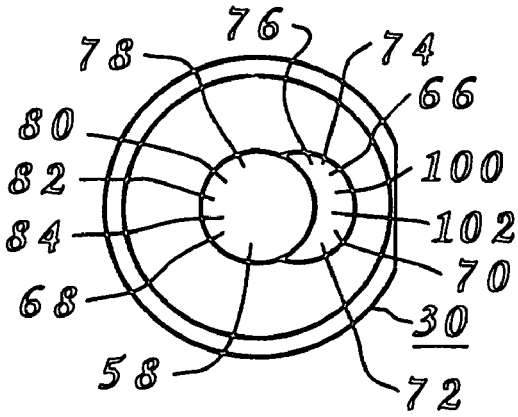
FIG. 8*a* is an enlarged top plan view of the height regulating portion of the adjustable height golf tee.
Figure 7:
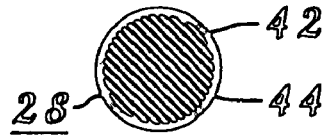
FIG. 7 is a sectional view of the tee portion of the adjustable height golf tee.
Figure 6:
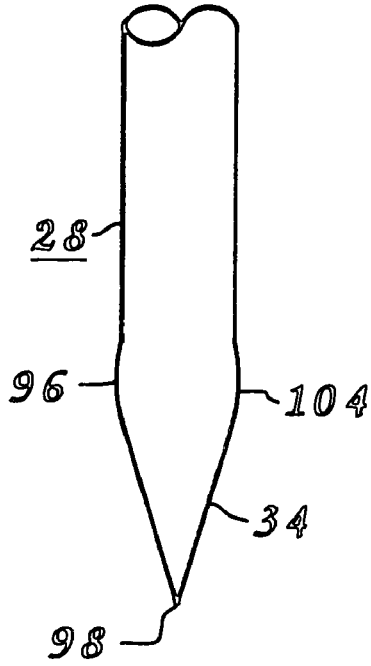
FIG. 6 is an enlarged elevational view of a portion of the tee portion of the adjustable height golf tee.
Figure 8B:
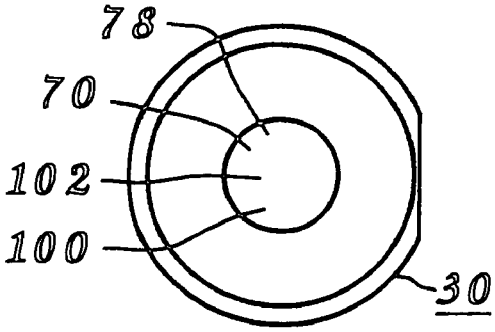
FIG. 8*b* is an enlarged bottom plan view of the height regulating portion of the adjustable height golf tee.

In the preferred embodiment depicted dual position passageway 58 has a common exit opening 64 on one side of height regulating portion 30 and opposing identifiable openings 66 and 68, best shown in FIG. 8*a*, on the opposing side of height regulating portion 30. Common exit opening 64 and opening 66 define a sliding passageway 70, best shown in FIG. 8*a* and FIG. 8*b*, through height regulating portion 30 which has a uniform shape 72 and dimensional sizing 74 along an entire length 76 of sliding passageway 70 which permits a ready and easy sliding movement of height' regulating portion 30 by the user along portion 60 of tee portion 28 corresponding to placement zone 36. This orientation between height regulating portion 30 and tee portion 28 is adjustable position 52. Preferably, while in adjustable position 52 this contact between height regulating portion 30 and tee portion 28 is tight enough to prevent free unbiased movement of height regulating portion 30 along tee portion 28 while permitting easy movement therealong by the user when manipulating the parts to deliberately move height regulating portion 30 relative to tee portion 28. Common exit opening 64 and opening 68 define a locking passageway 78, best shown in FIG. 8*a* and FIG. 8*b*, through height regulating portion 30 which has a uniform shape 80 and dimensional sizing 82 along a portion 84 of locking passageway 78 which permits a tight and secure engagement of height regulating portion 30 relative to tee portion 28. This orientation between height regulating portion 30 and tee portion 28 is locking position 62. Preferably while in locking position 62 this contact between height regulating portion 30 and tee portion 28 is tight enough to prevent all unbiased movement of height regulating portion 30 along tee portion 28 and most movement which might be biased by contact with other equipment during transport of height adjustable golf tee 20. Adjustable position 52 of height regulating portion 30 relative to placement zone 36 of tee portion 28 places ground contact side 54 of height regulating portion 30 at an angular offset 86 relative to axis 40 of placement zone 36 of tee portion 28. Locking position 62 of height regulating portion 30 relative to placement zone 36 of tee portion 28 places ground contact side 54 of height regulating portion 30 generally perpendicular relative to axis 40 of placement zone 36 of tee portion 28. Sliding passageway 70 and locking passageway 78 may have any desired cross section configuration desired. If desired the cross section configuration of placement zone 36 and sliding passageway 70 may cooperate to prevent rotation of height regulating portion 30 relative to tee portion 28. Such shapes may include true round, oval, and more elaborate shapes.

Height regulating portion 30 has a dedicated gripping guide 88 positioned on an exterior 90 thereof. Gripping guide 88 provides for the user to readily identify how to hold height adjustable golf tee 20 during transfer from locking position 62 to adjustable position 52 to indicate to the user a pressure direction 92 to bias height regulating portion 30 in during transfer from locking position 62 to adjustable position 52. Due to the preferred angular offset of height regulating portion 30 relative to tee portion 28 while in adjustable position 52 such guidance is typically not required during transfer from adjustable position 52 to locking position 62.

Operation

Figure 9A:
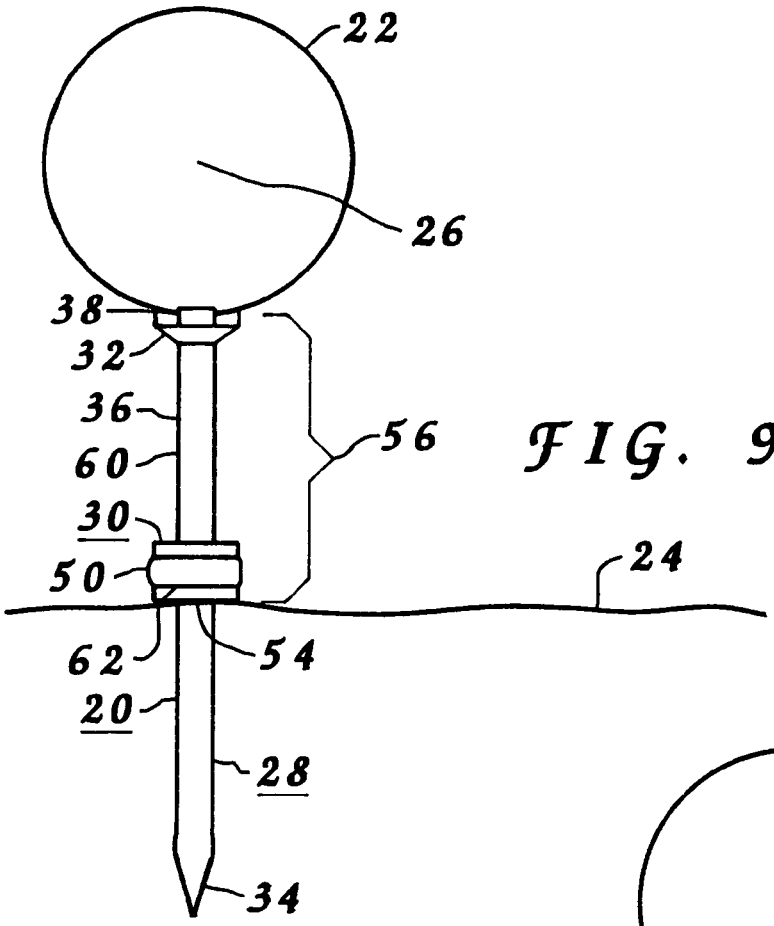
FIG. 9*a* and FIG. 9*b* are elevational views of the adjustable height golf tee deployed to support a golf ball above the ground and in alternative adjustment orientations.
Figure 9B:
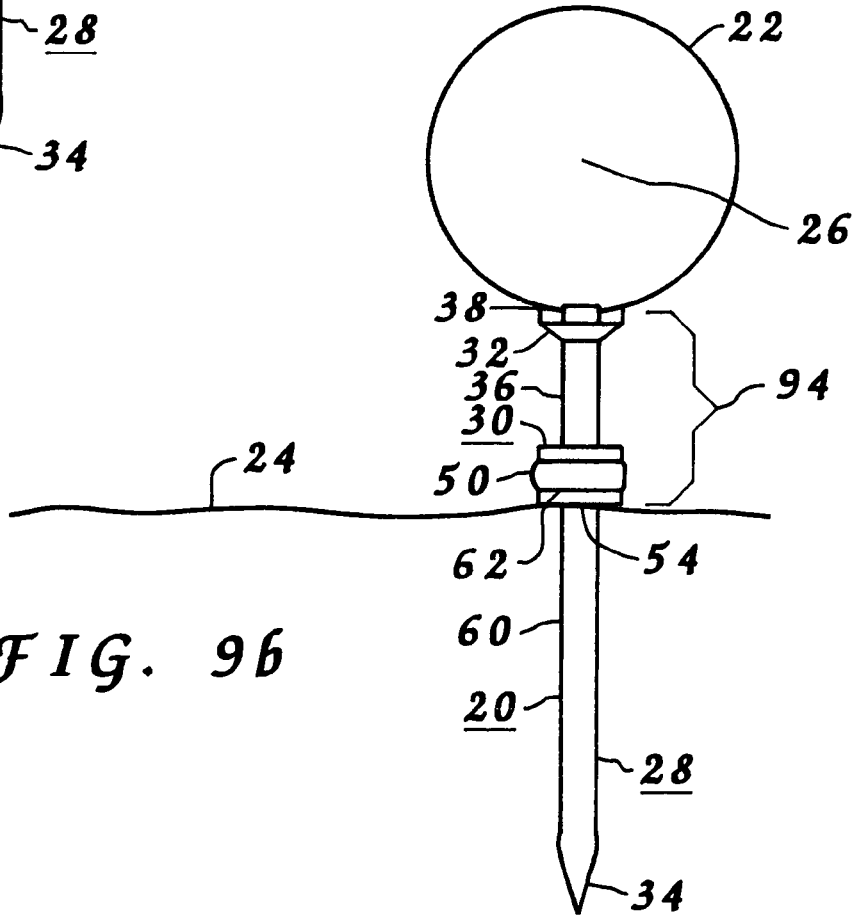

Height regulating portion has adjustable position 52, or orientation, relative to portion 60 corresponding to placement zone 36 of tee portion 28. Height regulating portion has locking position 62, or orientation, relative to portion 60 corresponding to placement zone 36 of tee portion 28. Adjustable position 52 provides for the user to selectably move height regulating portion 30 along the infinite number of adjustment locations within placement zone 36 to vary the spacing of ground contact side 54 of height regulating portion 30 relative to golf ball support area 38 of tee portion 28 and position height regulating portion 30 at any desired placement position, such as 50 shown in FIG. 9*a* or 94 shown in FIG. 9*b*, along placement zone 36 of tee portion 28. Locking position 62 provides for the user to selectably lock ground contact side 54 of height regulating portion 30 at a user selected spacing, such as 56 shown in FIG. 9*a* or 94 shown in FIG. 9*b*, selected from any desired position along placement zone 36 of tee portion 28.

Assembly of Height Adjustable Golf Tee

In the preferred embodiment depicted structural configurations of the parts provide for the parts to be locked together where incidental disconnect may not readily occur. Various structures may be deployed to provide this feature. Ideally, height regulating portion 30 and tee portion 28 will be configured so that easy assembly of the parts may occur while securely retaining the parts together subsequent to assembly. Locking means, such as the dimensional sizing of portions of height regulating portion 30 and tee portion 28 will provide this feature where incidental release is prevented where height adjustable golf tee 20 remains a functional device while being transported between uses to retain golf ball 22 at desired elevational position 26 above ground 24 during the play of the game of golf. A slightly larger size 96 of tee portion 28 at/near an end 98 of spike end 34 than size 44 of tee portion 28 along lacement zone 36 of tee portion 28 provides this desired locking when combined with a maximum size 100 of a collective passageway 102 through height regulating portion 30.

Figure 5A:
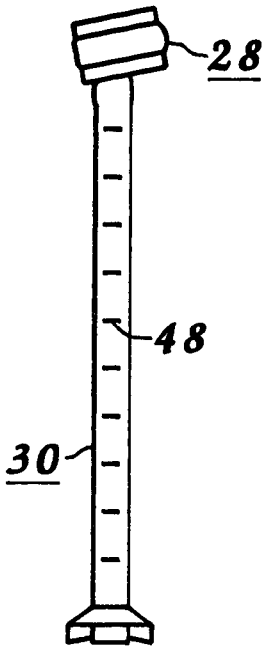
FIG. 5*a* through FIG. 5*c* are elevational views of the adjustable height golf tee during assembly and in various assembly orientations.
Figure 5B:
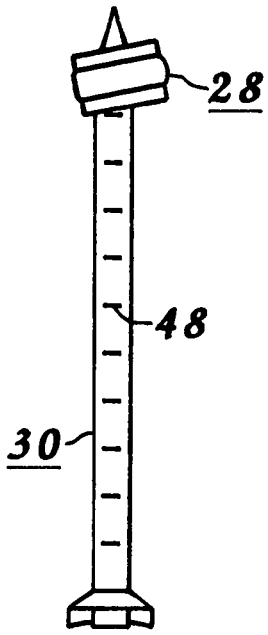
Figure 5C:
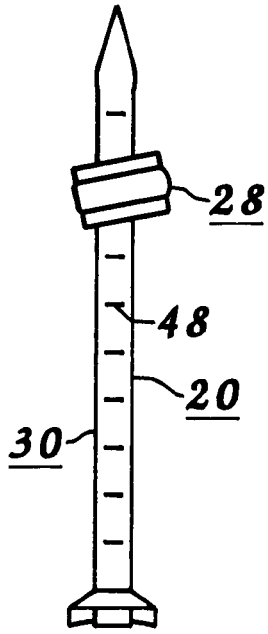

FIG. 5*a* through FIG. 5*c* depict assembly of height adjustable golf tee 20. Height regulating portion 30 has sliding passageway 70 therethrough to engage placement zone 36 of tee portion 28 subsequent to assembly. FIG. 5*a* depicts placement of height regulating portion 30 relative to tee portion 28 at the beginning of the installation procedure. Spike end 34 of tee portion 28 has a configuration 104 which may not readily pass through sliding passageway 70 of height regulating portion 30. A press, as conventionally known and not depicted, applies a pressure to height regulating portion 30 to forcefully move height regulating portion 30 over configuration 104 of spike end 34 of tee portion 28, see transfer from FIG. 5*a* to FIG. 5*b* to FIG. 5*c*, where spike end 34 of tee portion 28 is forced through sliding passageway 70 of height regulating portion 30 during assembly of height adjustable golf tee 20.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A height adjustable golf tee to support a golf ball above the ground at a user selectable elevation during play of the game of golf, the height adjustable golf tee comprising:

a) a tee portion having:

i) a golf ball placement end having a golf ball support area to contact the golf ball to retain the golf ball relative to the tee portion where the golf ball is retained at a desired elevational position above the ground during the play of the game of golf;

ii) a spike end to penetrate the ground while the height adjustable golf tee is supporting the golf ball above the ground during play of the game of golf;

iii) a placement zone positioned between the spike end and the golf ball placement end;

b) a height regulating portion slidably engaging the tee portion along the placement zone for user selectable placement in any desired position within an infinite number of adjustment locations limited only by precision of measurement restrictions, the height regulating portion having:

i) a ground contact side for placement relative to the ground during an insertion of the height adjustable golf tee into the ground during play of the game of golf;

ii) an adjustable position relative to the placement zone of the tee portion wherein the user may selectably move the height regulating portion along the infinite number of adjustment locations within the placement zone to vary a spacing of the ground contact side of the height regulating portion relative to the golf ball support area of the tee portion and position the height regulating portion at any desired placement position along the placement zone of the tee portion;

iii) a locking position wherein the user may lock the ground contact side of the height regulating portion at a user selected placement position selected from any desired position along the placement zone of the tee portion;

c) locking means to lock the height regulating portion on the tee portion wherein incidental release is prevented wherein the height adjustable golf tee remains a functional device while being transported between uses to retain the golf ball at the desired elevational position above the ground during the play of the game of golf.

2. The height adjustable golf tee defined in claim 1 wherein the placement position of the height regulating portion along the placement zone of the tee portion may be selected at any position by the user from an infinite number of adjustment locations limited only by precision of measurement restrictions.

3. The height adjustable golf tee defined in claim 1 wherein the locking means further comprises a slightly larger size of the tee portion at the spike end than the size of the tee portion along the placement zone of the tee portion.

4. The height adjustable golf tee defined in claim 1 wherein the height regulating portion has a sliding passageway therethrough to engage placement zone of the tee portion and wherein the spike end of the tee portion has a configuration which may not readily pass through the sliding passageway of the height regulating portion and wherein the spike end of the tee portion is forced through the sliding passageway of the height regulating portion during assembly of the height adjustable golf tee.

5. The height adjustable golf tee defined in claim 1 wherein the placement zone of the tee portion has a uniform shape and dimensional sizing along an entire length of the placement zone.

6. The height adjustable golf tee defined in claim 1 wherein the placement zone of the tee portion generally has an axis and wherein the locking position of the height regulating portion relative to the placement zone of the tee portion places the ground contact side of the height regulating portion generally perpendicular relative to the axis of the placement zone of the tee portion and wherein the adjustable position of the height regulating portion relative to the placement zone of the tee portion places the ground contact side of the height regulating portion at an angular offset relative to both the axis of the placement zone of the tee portion and to the generally perpendicular placement of the height regulating portion while in the locking position.

7. The height adjustable golf tee defined in claim 1 further comprising a series of markings along the placement zone of the tee portion indicative of a measurement spacing of the golf ball support area of the tee portion relative to the ground when the spike end of the tee portion of the height adjustable golf tee is inserted in the ground during the play of the game of golf utilizing the placement of the height regulating portion at the placement position selected by the user.

8. A height adjustable golf tee to support a golf ball above the ground at a user selectable elevation during play of the game of golf, the height adjustable golf tee comprising:

a) a tee portion having:

i) a golf ball placement end having a golf ball support area to contact the golf ball to retain the golf ball relative to the tee portion where the golf ball is retained at a desired elevational position above the ground during the play of the game of golf;

ii) a spike end to penetrate the ground while the height adjustable golf tee is supporting the golf ball above the ground during play of the game of golf;

iii) a placement zone positioned between the spike end and the golf ball placement end;

b) a height regulating portion slidably engaging the tee portion along the placement zone for user selectable placement in any desired position within an infinite number of adjustment locations limited only by precision of measurement restrictions, the height regulating portion having:

i) a ground contact side for placement relative to the ground during an insertion of the height adjustable golf tee into the ground during play of the game of golf;

ii) an adjustable position relative to the placement zone of the tee portion wherein the user may selectably move the height regulating portion along the infinite number of adjustment locations within the placement zone to vary a spacing of the ground contact side of the height regulating portion relative to the golf ball support area of the tee portion and position the height regulating portion at any desired placement position along the placement zone of the tee portion;

iii) a locking position wherein the user may lock the ground contact side of the height regulating portion at a user selected placement position selected from any desired position along the placement zone of the tee portion.

9. The height adjustable golf tee defined in claim 8 further comprising locking means to lock the height regulating portion on the tee portion wherein incidental release is prevented wherein the height adjustable golf tee remains a functional device while being transported between uses to retain the golf ball at the desired elevational position above the ground during the play of the game of golf.

10. The height adjustable golf tee defined in claim 9 wherein the locking means further comprises a slightly larger size of the tee portion at the spike end than the size of the tee portion along the placement zone of the tee portion.

11. The height adjustable golf tee defined in claim 8 wherein the height regulating portion has a sliding passageway therethrough to engage placement zone of the tee portion and wherein the spike end of the tee portion has a configuration which may not readily pass through the sliding passageway of the height regulating portion and wherein the spike end of the tee portion is forced through the sliding passageway of the height regulating portion during assembly of the height adjustable golf tee.

12. The height adjustable golf tee defined in claim 8 wherein the placement zone of the tee portion has a uniform shape and dimensional sizing along an entire length of the placement zone.

13. The height adjustable golf tee defined in claim 8 wherein the placement zone of the tee portion generally has an axis and wherein the adjustable position of the height regulating portion relative to the placement zone of the tee portion places the ground contact side of the height regulating portion at an angular offset relative to axis of the placement zone of the tee portion and wherein the locking position of the height regulating portion relative to the placement zone of the tee portion places the ground contact side of the height regulating portion generally perpendicular relative to the axis of the placement zone of the tee portion.

14. The height adjustable golf tee defined in claim 8 further comprising a series of markings along the placement zone of the tee portion indicative of a measurement spacing of the golf ball support area of the tee portion relative to the ground when the spike end of the tee portion of the height adjustable golf tee is inserted in the ground during the play of the game of golf utilizing the placement of the height regulating portion at the placement position selected by the user.

15. A height adjustable golf tee to support a golf ball above the ground at a user selectable elevation during play of the game of golf, the height adjustable golf tee comprising:

a) a tee portion having:

i) a golf ball placement end having a golf ball support area to contact the golf ball to retain the golf ball relative to the tee portion where the golf ball is retained at a desired elevational position above the ground during the play of the game of golf;

ii) a spike end to penetrate the ground while the height adjustable golf tee is supporting the golf ball above the ground during play of the game of golf;

iii) a placement zone positioned between the spike end and the golf ball placement end and wherein the placement zone generally has an axis and wherein the placement zone has a uniform shape and dimensional sizing along an entire length of the placement zone;

b) a height regulating portion slidably engaging the tee portion along the placement zone, the height regulating portion having:

i) a ground contact side for placement relative to the ground during an insertion of the height adjustable golf tee into the ground during play of the game of golf;

ii) a dual position passageway therethrough, the dual position passageway to receive the placement zone of the tee portion and to provide for user selective transfer of the height regulating portion relative to the placement zone of the tee portion between opposing positions, the opposing positions an adjustable position and a locking position, the adjustable position an orientation relative to the placement zone of the tee portion wherein the user may selectably move the height regulating portion along the placement zone to vary a spacing of the ground contact side of the height regulating portion relative to the golf ball support area of the tee portion and position the height regulating portion at any desired placement position along the placement zone of the tee portion, the locking position an orientation relative to the placement zone of the tee portion wherein the user may lock the ground contact side of the height regulating portion at a user selected placement position selected from any desired position along the placement zone of the tee portion;

c) locking means to lock the height regulating portion on the tee portion wherein incidental release is prevented wherein the height adjustable golf tee remains a functional device while being transported between uses to retain the golf ball at the desired elevational position above the ground during the play of the game of golf.

16. The height adjustable golf tee defined in claim 15 wherein the adjustable position of the height regulating portion relative to the placement zone of the tee portion places the ground contact side of the height regulating portion at an angular offset relative to the axis of the placement zone of the tee portion and wherein the locking position of the height regulating portion relative to the placement zone of the tee portion places the ground contact side of the height regulating portion generally perpendicular relative to the axis of the placement zone of the tee portion.

17. The height adjustable golf tee defined in claim 15 wherein the dual position passageway of the height regulating portion has a common exit opening on one side of the height regulating portion.

18. The height adjustable golf tee defined in claim 15 wherein the height regulating portion further comprises a dedicated gripping guide positioned on an exterior thereof and for use by the user during transfer from the locking position to the adjustable position to indicate to the user a pressure direction to bias the height regulating portion in during transfer from the locking position to the adjustable position.

19. The height adjustable golf tee defined in claim 15 further comprising a series of markings along the placement zone of the tee portion indicative of a measurement spacing of the golf ball support area of the tee portion relative to the ground when the spike end of the tee portion of the height adjustable golf tee is inserted in the ground during the play of the game of golf utilizing the placement of the height regulating portion at the placement position selected by the user.

* * * * *